United States Patent [19]

Matsuzaki et al.

[11] Patent Number: 4,917,629

[45] Date of Patent: Apr. 17, 1990

[54] ELECTRICAL CONNECTOR AND TERMINATION METHOD THERETO

[75] Inventors: Shuichi Matsuzaki; Shigeru Kikuta, both of Tokyo, Japan

[73] Assignee: Hirose Electric Co, Ltd., Tokyo, Japan

[21] Appl. No.: 312,213

[22] Filed: Feb. 21, 1989

[30] Foreign Application Priority Data

Mar. 7, 1988 [JP] Japan ..... 63-53287
May 19, 1988 [JP] Japan ..... 63-122596

[51] Int. Cl.[4] ..... H01R 4/24

[52] U.S. Cl. ..... 439/405; 439/407; 439/449; 439/607; 29/866

[58] Field of Search ..... 439/676, 344, 733, 751, 439/741, 586, 589, 592, 374, 451, 452, 453, 455, 459, 460, 463, 465, 467, 395, 399, 400, 401, 404–407, 449, 607; 29/857, 861, 863, 865, 866, 867

[56] References Cited

U.S. PATENT DOCUMENTS

| | | | |
|---|---|---|---|
| 4,601,530 | 7/1986 | Coldren | 439/460 |
| 4,636,024 | 1/1987 | Yahata | 439/449 |
| 4,671,596 | 6/1987 | Soma | 439/404 |
| 4,734,054 | 3/1988 | Steffinger | 439/407 |
| 4,753,608 | 6/1988 | Yamaguchi | 439/417 |
| 4,767,355 | 8/1988 | Phillipson et al. | 439/676 |
| 4,838,811 | 6/1989 | Nakamura | 439/610 |

FOREIGN PATENT DOCUMENTS

| | | | |
|---|---|---|---|
| 0090317 | 10/1983 | European Pat. Off. | 439/418 |
| 60-136480 | 9/1985 | Japan . | |
| 2079070 | 1/1982 | United Kingdom | 439/418 |

*Primary Examiner*—David Pirlot
*Attorney, Agent, or Firm*—Kanesaka & Takeuchi

[57] ABSTRACT

An electrical connector to which insulated conductors of a multiconductor cable are connected by insulation piercing, which includes an insulation housing having a front recess and a rear recess; a plurality of contacts arranged in the insulation housing so that their contacting sections are exposed in the front recess and their piercing sections project upwardly in the rear recess; and a guide block disposed in the rear recess and having a lateral slot in which the insulated conductors are arranged side by side at regular intervals, a plurality of vertical slots into which the piercing sections are inserted, and a deformation groove provided behind the vertical slots for securing the insulated conductors to the guide block when it is deformed.

3 Claims, 4 Drawing Sheets

110
111
113"
120
116
130
131
132
133'
140A
140B
143A
150
153
160
161
162
163
163'
170

ELECTRICAL CONNECTOR AND TERMINATION METHOD THERETO

BACKGROUND OF THE INVENTION

The present invention relates to electrical connectors and, more particularly, to an electrical connector to which insulated conductors of a multiconductor cable are connected by insulation piercing.

In recent years there is an increasing demand for compact and versatile electronic components. As a result, a multiconductor cable with thin insulated conductors has been proposed. However, this made it more difficult to terminate insulated conductors of such a cable to an electrical connector, and many attempts to solve it have been proposed. For example, a modular connector such as disclosed in Japanese U.M. Patent Application Kokai No. 60-136480 which is assigned to the same assignee as this application, has been proposed and now widely used. This modular connector is provided with a conductor pitch correction adapter which is useful for arranging thin insulated conductors of a multiconductor cable to facilitate their connections to contacts.

However, the above modular connector has the following shortcomings.

(1) Since insulated conductors are terminated to contacts after the insulated conductors projecting from the correction adapter are inserted into the conductor receiving slot, the insulated conductors are buckled or difficult to insert into the receiving slot in the case of thin insulated conductors or a cable having a great number of insulated conductors.

(2) The insulated conductors are not fixed until the cable and the insulated conductors are secured to the insulated housing by deformation of fixing portions after they are arranged in the adapter and inserted into the receiving slot.

(3) By the process in which steps of arranging insulated conductors, inserting the insulated conductors, and piercing the insulation are carried out separately, the insulated conductors projecting from the adapter are buckled during transportation so that it is necessary to not only arrange the projecting insulated conductors in the conductor insertion step but also check if the piercing sections are inserted into the housing before push.

SUMMARY OF THE INVENTION

Accordingly, it is an object of the present invention to provide an electrical connector which is free of the above problems.

According to one aspect of the present invention there is provided an electrical connector to which insulated conductors of a multiconductor cable are connected by insulation piercing, which includes an insulation housing having a front recess and a rear recess; a plurality of contacts arranged in the insulation housing so that their contacting sections are exposed in the front recess and their piercing sections project upwardly in the rear recess; and a guide block placed in the rear recess and having a lateral slot in which the insulated conductors are arranged side by side at regular intervals, a plurality of vertical slots into which the piercing sections are inserted, and a deformation groove provided behind the vertical slots for securing the insulated conductors to the guide block when it is deformed.

According to another aspect of the present invention there is provided a method of terminating insulated conductors of a multiconductor cable to an electrical connector of claim 1, which includes the steps of treating an end portion of the multiconductor cable for exposing the insulated conductors; inserting the exposed insulated conductors into the lateral slot for arrangement; deforming the deformation groove to secure the insulated conductors to the guide block; and pushing the guide block into the rear recess of the insulation housing so that the piercing sections of the contacts are inserted into the vertical slots to connect by insulating piercing the insulated conductors to the piercing sections.

Other objects, features, and advantages of the present invention will be apparent from the following description taken in conjunction with the accompanying drawings.

DESCRIPTION OF THE PREFERRED EMBODIMENT

Figure 1:
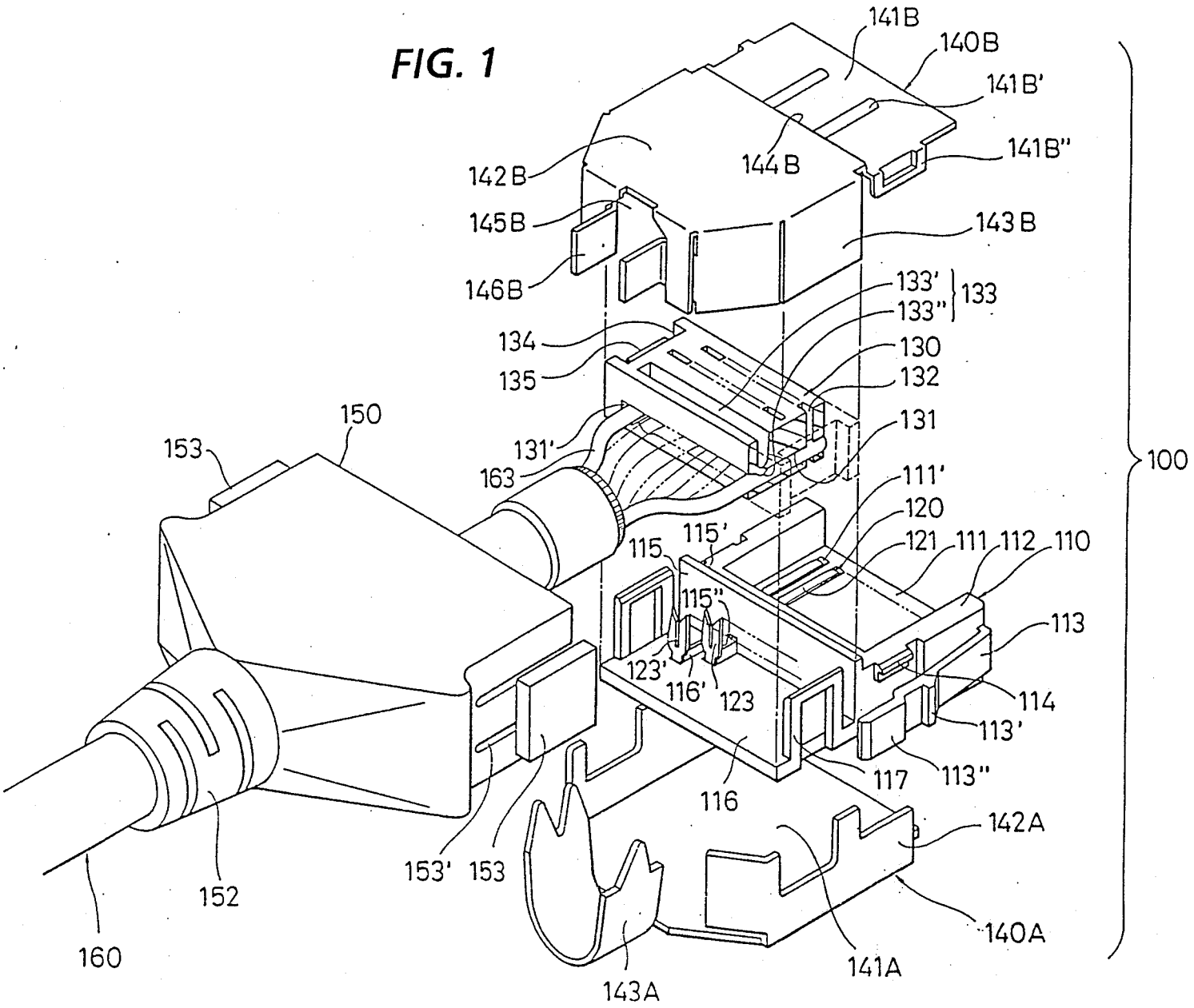
FIG. 1 is an exploded perspective view of an electrical connector plug according to an embodiment of the invention.

FIG. 1 shows an electrical connector plug 100 according to an embodiment of the invention. The electrical connector plug 100 includes an insulation housing 110, a plurality of contacts 120, a guide block 130, a pair of shield case sections 140A and 140B, and a cover case 150.

The insulation housing 110 is made of an insulation material, such as a plastic, so as to have a pair of side walls 112 which define a fitting or front recess 111 toward its front end. A plurality of contact channels 111' are provided on the bottom of the front recess 111. A locking leg 113 is made integral with the side wall 112 so as to extend rearwardly from the front end of the side wall 112. This locking leg 113 is made flexible toward the side wall 112 and has a locking protuberance 113' on its middle surface and a push button 113'' on its free end. A shield latch protuberance 114 is provided on the upper outside of the side wall 112.

An intermediate wall 115 provided on the middle of the insulation housing 110 has a shoulder 115' and a plurality of channels 115'' through its bottom. A guide block or rear recess 116 is provided on the rear portion of the insulation housing 110. A plurality of channels 116' are provided on the bottom of the rear recess 116 for receiving insulation piercing portions of contacts 120. A pair of guide block latch arms 117 are provided on opposite sides of the rear recess 116.

The contact 120 is made of spring sheet metal so as to have a contacting section 121 for engagement with a matching contact, an intermediate section 122, and an insulating piercing section 123 with a slit 123' for terminating an insulated conductor by insulation piercing techniques.

The guide block 130 is made of an insulation material, such as a plastic, so as to have a lateral slot 131 for receiving a single layer of insulated conductors of a multiconductor cable. The entrance 131' of the lateral slot 131 is tapered so as to facilitate insertion of the insulated conductors. A plurality of vertical slots 132 are aligned alternately in a pair of parallel planes perpendicular to the lateral slot 131 for each receiving the insulation piercing section of a contact. An elongated deformation portion 133 defined by a deformation groove 133' and a deformation protuberance 133'' is provided between the rear end of the guide block 130 and the vertical slots 132 to hold the insulated conductors in place within the guide block 130. Provided on opposite sides of the guide block 130 is a pair of latch protuberances 135 and grooves 134 for engagement with the latch arms 117 for latching the guide block 130 with the insulation housing 110.

The upper and lower shield case sections 140B and 140A are provided as EMI countermeasure and made of brass or another conductive material requiring no spring property, and plated with solder. The lower shield case section 140A has a housing receiving section 141A, a pair of side walls 142A, a deformation tab 143A, and a pair of contact ribs 141A'. The upper shield case 140B has a fitting flat portion 141B, a pair of contact ribs 141B', a rear enclosure 142B, side walls 143B, a shoulder 144B, a cable mouth 145B, and a pair of deformation tabs 146B.

Figure 2:
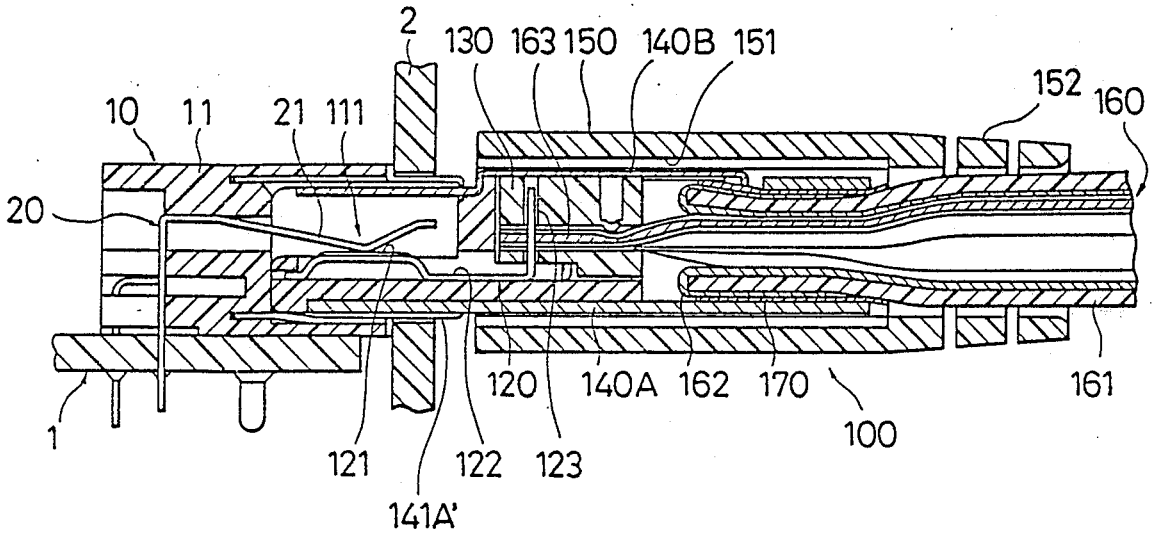
FIG. 2 is a sectional view of the electrical connector plug of FIG. 1 which is connected to a mating connector receptacle.

The cover case 150 is made of an insulation material such as a plastic so as to have a unit receiving recess 151 for receiving a connector unit enclosed by the shield case 140A and 140B (see FIG. 2). Provided at the rear end of the cover case 150 is a cable outlet 152 through which a multiconductor cable 160 is pulled out. A pair of push buttons 153 are provided on opposite sides of the cover case 150. A pair of slits 153' are provided on the side wall of the cover case 150 along both the sides of each push button 153 to give the push button flexibility.

Figure 4:
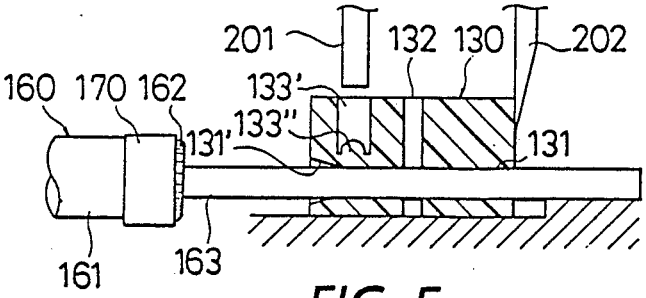
FIG. 4 is a sectional view for illustrating steps of arranging and holding insulated conductors by deformation.
Figure 5:
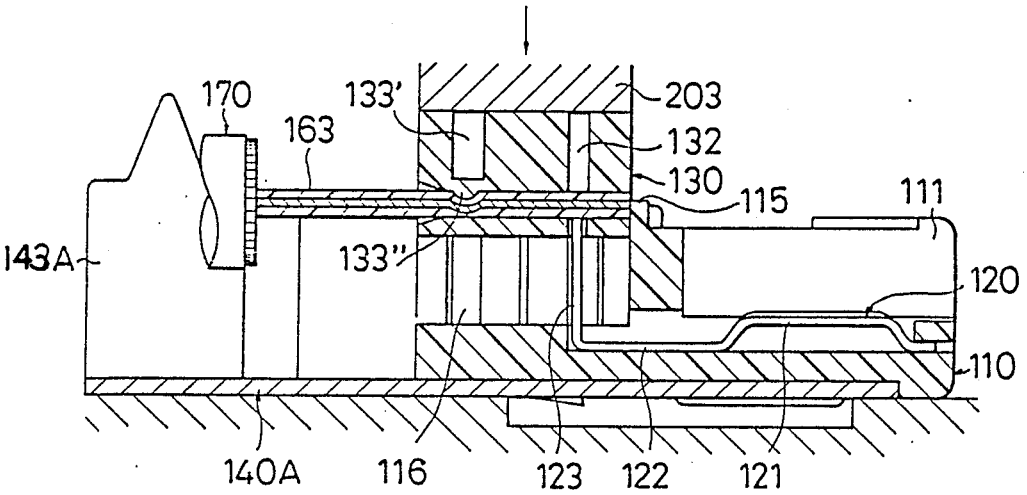
FIG. 5 is a sectional view for illustrating a step of placing the guide block in the rear recess of an insulation housing for connection by insulation piercing.

A method of assembling the electrical connector and a method of terminating a multiconductor cable will be described with reference to FIGS. 3–5.

Figures 3A, 3B, 3C, 3D, 3E, 3F, 3G, 3H, 3I, 3J:
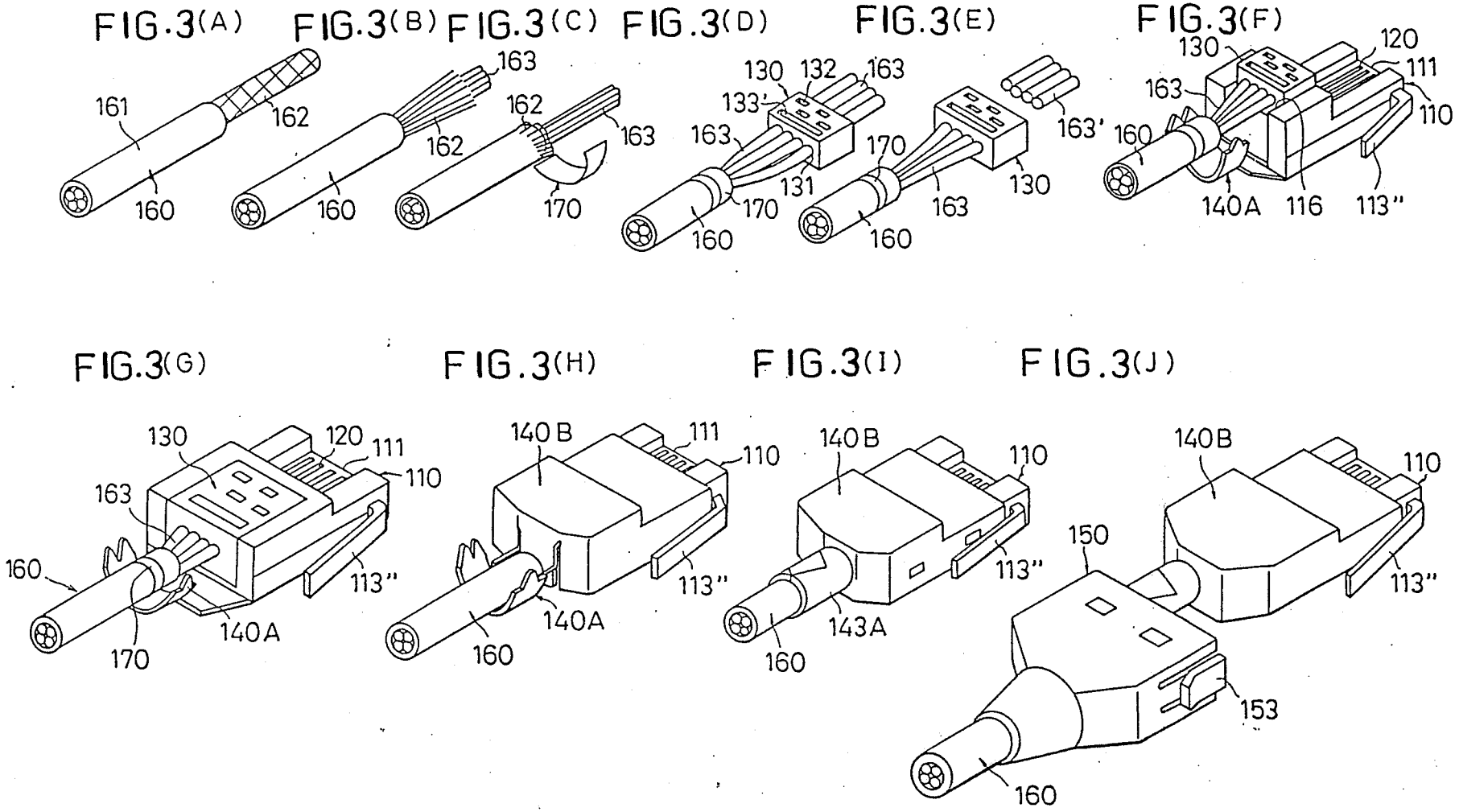
FIGS. 3A–3J are a perspective view for illustrating steps of termination and assembling the electrical connector plug of FIG. 1.

(1) In FIG. 3A, the sheath 161 of a tip of the multiconductor cable 160 is stripped to expose meshed shield wires 162.

(2) In FIGS. 3B and 3C, the meshed shield wires 162 are loosened and folded back on the sheath around which a conductive tape 170, such as a copper tape, is wound for terminal treatment.

(3) In FIG. 3D, the insulated conductors 163 are arranged and inserted into the lateral slot 131 of the guide block 130. As shown in FIG. 4, a deforming tool 201 and a cutting blade 202 are lowered so that the deforming tool 201 enters the deformation groove 133' while the excess wires 163' projecting from the guide block 130 are cut off. This condition is shown in FIG. 3E. As best shown in FIG. 5, the deformation protuberance 133'' has been pushed into the lateral slot 131 by the deforming tool 201 to secure the respective insulated conductors 163 to the guide block 130 in an arranged state.

(4) In FIG. 3F, the insulation housing 110 with the contacts 120 arranged thereon is mounted on the shield case 140A, and the guide block 130 with the cable 160 secured thereto is fitted into the rear recess 116 of the insulation housing 110. As shown in FIG. 5, the guide block 130 is pushed into the rear recess 116 by an insulation piercing tool 203 so that the respective insulated conductors are connected by insulation piercing to the insulation piercing sections of the contacts 120. This condition is shown in FIG. 3G. As best shown in FIG. 5, the respective contacts 120 are arranged in the contact channels 111' so that the contact sections 121 are exposed in the front recess 111 of the insulation housing 110 and the piercing sections 123 project upwardly through contact channels 116' provided on the bottom of the rear recess 116.

(5) In FIG. 3H, the shield case 140B is put on and, in FIG. 3I, the deformation tabs 143A of the shield case 140A are deformed around the conductive tape wrapped portion of the cable 160. It is noted that the deformation tabs 146B of the shield case 140B are also deformed together with the deformation tabs 143A.

(6) In FIG. 3J, the cover case 150 is put on to complete the termination of the cable and the assembly of the connector plug.

As shown in FIG. 2, the electrical connector plug 100 thus assembled is connected to a mating electrical connector receptacle 10 which is mounted on a printed circuit board 1 so that its front end is projected through the opening of a panel 2. Under this condition, the contacts 20 on the insulation housing 11 are brought into contact with the contact sections 121 of the contacts 120 in the connector plug 100.

Figure 6:
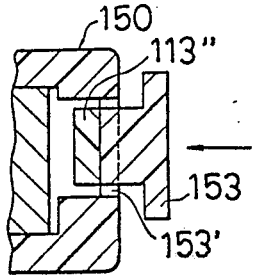
FIG. 6 is a sectional view for illustrating the relationship between the button seat of a lock piece and the push button of a cover case.

As shown in FIG. 6, when the cover case 150 is put on, the push button 153 of the cover case 150 rests on the seat 113'' of a lock piece 113 provided on either side of the insulation housing 110. By pushing the button 153 in the direction of an arrow, the lock piece 113 is flexed inwardly to facilitate release of the lock protuberance 113' from the mating connector.

Figure 7:
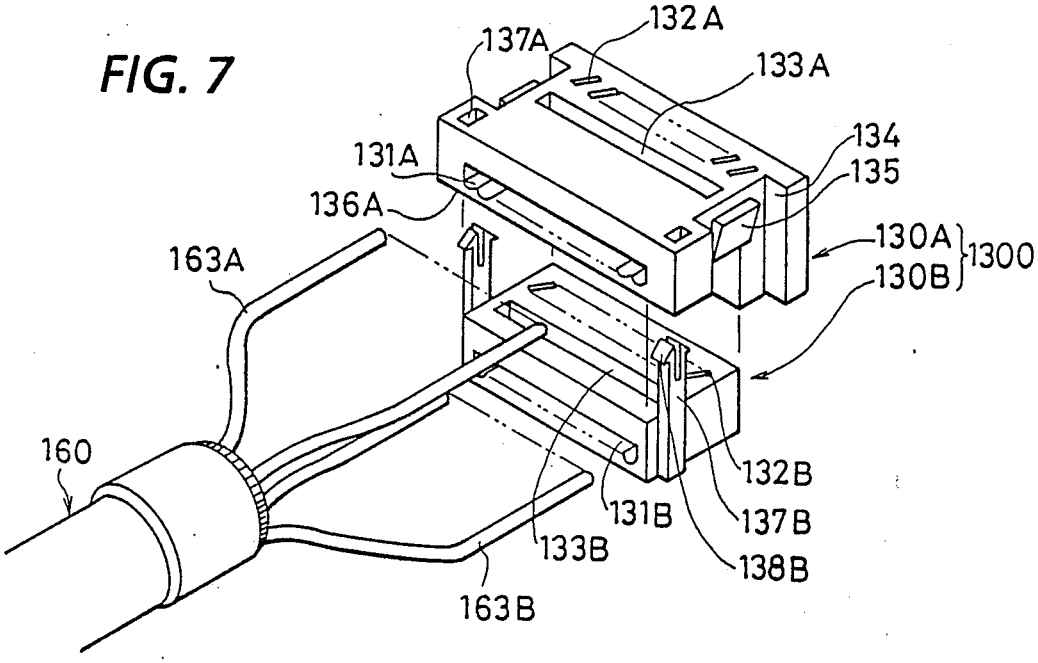
FIG. 7 is an exploded perspective view of the guide block of an electrical connector according to another embodiment of the present invention.

FIG. 7 shows the relationship between the insulated conductors of a multiconductor cable and the guide block of an electrical connector according to another embodiment of the present invention. Unlike the above electrical connector wherein the guide block 130 has a single lateral slot 131 so that the insulated conductors are connected by insulation piercing in a single plane, this electrical connector makes it possible to connect by insulation piercing insulated conductors in different parallel planes thus increasing the connection density.

The guide block 1300 includes a first guide block section 130A and a second guide block section 130B. The first guide block section 130A has a lateral slot 131A for receiving insulated conductors, a row of vertical slots 132A for receiving piercing walls, and a deformation groove 133A. Preferably, the vertical slots 132A are inclined at a certain angle with respect to the side walls of the guide block 1300 to increase the density at which insulated conductors are arranged.

The first guide block section 130A has a rear bottom recess 136A for receiving the second guide block 130B and a pair of latch slots 137A for receiving the latch arms 137B of the second guide block section 130B. The other structure is similar to that of the above embodiment.

Similarly, the second guide block 130B has a lateral slot 131B for receiving insulated conductors, vertical slots 132B for receiving insulation piercing walls, and a deformation groove 133B. It also includes a pair of spear-shaped latch arms 137B extending upwardly from its opposite sides each having a slitted head 138B. The other structure is similar to that of the above embodiment.

Figure 8:
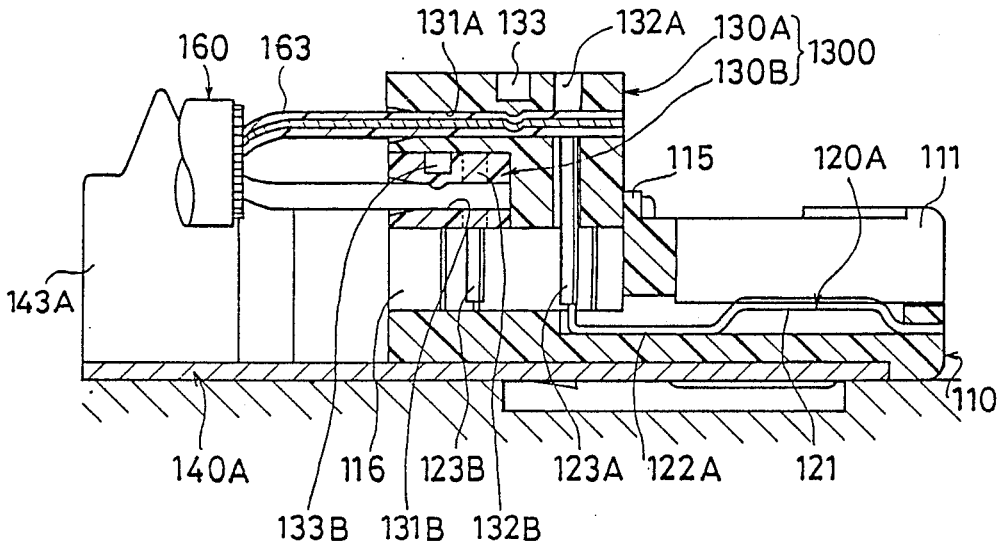
FIG. 8 is a sectional view showing how to terminate a multiconductor cable to the electrical connector of FIG. 7.

FIG. 8 shows how to assemble the electrical connector of FIG. 7 and terminate a multiconductor cable thereto.

(1) As shown in FIG. 7, the insulated conductors of a multiconductor cable 160 are separated into upper and lower rows. The upper conductors 163A are inserted into the lateral slot 131A of a first guide block section 130A. In the same way as in the above embodiment, a deforming tool and a conductor cutter are then lowered to secure the insulated conductor 163A to the first guide block section 130A and cut off the excess conductors projecting from the front end of the first guide block section 130A. Similarly, the lower conductors 163B are inserted into the lateral slot 131B of a second guide block section 130B to secure them to the second guide block section 130B.

(2) As shown in FIG. 8, the second guide block section 130B is fitted into the bottom recess 136A of the first guide block section 130A while the latch arms 137B are inserted into the latch slots 137B of the first guide block section 130A to form an integrated guide block 1300 with a flush bottom.

(3) The guide block 1300 with the cable attached thereto is placed over the upper rear recess 116 of an insulation housing 110 with contacts 120A arranged therein. This insulation housing 110 may be identical with that of the above embodiment, but the arranged contacts 120A are divided into tow types; the first type contacts having a longer piercing wall 123A and the second type contacts having a shorter piercing wall 123B. The respective piercing walls 123A and 123B are turned so as to fit into angled vertical slots 132A of the first guide block section 130A and angled vertical slots 132B of the second guide block section 130B. The guide block 1300 is then pressed into the rear recess by means of an insulation piercing tool (not shown) to thereby connect the insulated conductors to the contacts. The other steps are similar to those of the above embodiment.

In the above embodiments, the insulation housing has front and rear recesses on the top side, but it is also possible to provide front and rear recesses on the bottom side, thus providing higher connection density.

According to the invention there are provided the following advantages.

(1) Since the guide block is useful for arranging insulated conductors, holding the insulated conductors by deformation, and supporting the insulation piercing sections of contacts, the insulated conductors of a multiconductor cable may be readily terminated without being buckled.

(2) The termination by insulation piercing of insulated conductors to contacts and the mounting of a guide block into an insulation housing may be accomplished with one push, making the termination operation simpler, the mass production easier, and the unit manufacturing cost lower than before.

(3) Since the insulated conductors do not project from the front end of a guide block, not only no insulated conductors are buckled during transportation but also it is not necessary to check the position of a guide block in the insulation piercing operation, making the manufacturing operation and the mass production even easier than before even if the separate steps of conductor arrangement, conductor insertion, and insulation piercing operations are employed.

(4) With the embodiment of FIGS. 7 and 8, the insulated conductors of a multiconductor cable may be terminated in a plurality of different parallel planes to provide a compact high-connection density electrical contact.

While a preferred embodiment of the invention has been described using specific terms, such description is given for illustrative purposes only, and it is to be understood that changes and variations may be made without departing from the spirit and scope of the invention as recited in the appended claims.

What is claimed is:

1. An electrical connector to which insulated conductors of a multiconductor cable are connected by insulation piercing, which comprises:

an insulation housing having a front recess and a rear recess;

a plurality of contacts arranged in said insulation housing such that contacting sections of said contacts are exposed in said front recess and piercing sections of said contacts project upwardly in said rear recess; and a guide block disposed in said rear recess and having a lateral slot extending in a horizontal plane in which said insulated conductors are arranged side by side at regular intervals, a plurality of vertical slots into which said piercing sections are inserted, and a deformation groove extending along said horizontal plane and at right angles to said insulated conductors and provided behind said vertical slots for securing said insulated conductors to said guide block when it is deformed.

2. A method of terminating insulated conductors of a multiconductor cable to an electrical connector of claim 1, which comprises the steps of:

treating an end portion of said multiconductor cable for exposing said insulated conductors;

inserting said exposed insulated conductors into said lateral slot for arrangement;

deforming said deformation groove to secure said insulated conductors to said guide block; and pushing said guide block into said rear recess of said insulation housing so that said piercing sections of said contacts are inserted into said vertical slots to connect by insulation piercing said insulated conductors to said piercing sections.

3. An electrical connector to which insulated conductors of a multiconductor cable are connected by insulation piercing, which comprises:

an insulation housing having a front recess and a rear recess;

a plurality of contacts arranged in said insulation housing such that contacting sections of said contacts are exposed in said front recess and piercing sections of said contact project upwardly in said rear recess;

a guide block disposed in said rear recess and having a lateral slot extending in a horizontal plane in which said insulated conductors are arranged side by side at regular intervals, a plurality of vertical slots into which said piercing sections are inserted, and a deformation groove extending along said horizontal plane and at right angles to said insulated conductors and provided behind said vertical slots for securing said insulated conductors to said guide block when it is deformed;

said contacts consists of at least two types of contacts; a first type of contacts having a longer piercing wall and a second type of contacts having a shorter piercing wall; and said guide block consists of at least two guide block sections which are placed one upon another, each guide block section having a lateral slot for receiving said insulated conductors arranged at intervals equal to those of said piercing walls arranged in said rear recess of said insulating housing, a plurality of vertical slots for receiving said piercing walls, and a deformation groove provided behind said vertical slots so that said insulated conductors are connected in at least two different parallel horizontal planes.

* * * * *